US008370165B2

(12) United States Patent
Snapp et al.

(10) Patent No.: US 8,370,165 B2
(45) Date of Patent: Feb. 5, 2013

(54) METHODS AND SYSTEMS FOR PROVIDING AN ALTERNATIVE DELIVERY POINT CODE

(75) Inventors: Robert F. Snapp, Memphis, TN (US); Michael C. Garner, Collierville, TN (US); James D. Wilson, Collierville, TN (US); David J. Payne, Collierville, TN (US)

(73) Assignee: United States Postal Service, Washington, DC (US)

( * ) Notice: Subject to any disclaimer, the term of this patent is extended or adjusted under 35 U.S.C. 154(b) by 1051 days.

(21) Appl. No.: 10/820,796

(22) Filed: Apr. 9, 2004

(65) Prior Publication Data

US 2005/0021481 A1 Jan. 27, 2005

Related U.S. Application Data

(60) Provisional application No. 60/462,555, filed on Apr. 11, 2003.

(51) Int. Cl.
*G06Q 99/00* (2006.01)

(52) U.S. Cl. ..... 705/1.1; 705/7.11

(58) Field of Classification Search ..... 705/1, 404, 705/405, 410, 1.1, 7.1
See application file for complete search history.

(56) References Cited

U.S. PATENT DOCUMENTS

| | | | | |
|---|---|---|---|---|
| 5,901,214 | A * | 5/1999 | Shaffer et al. | 379/211.02 |
| 6,097,802 | A * | 8/2000 | Fleischer et al. | 379/211.02 |
| 2004/0211834 | A1 * | 10/2004 | Fleckenstein et al. | 235/385 |
| 2006/0031213 | A1 * | 2/2006 | Wilson et al. | 707/3 |

* cited by examiner

*Primary Examiner* — Akiba Allen
(74) *Attorney, Agent, or Firm* — Finnegan, Henderson, Farabow, Garrett & Dunner LLP

(57) ABSTRACT

Systems and methods for providing an alternative delivery point code may comprise receiving delivery data corresponding to a delivery point. Furthermore, the systems and methods may include determining if the delivery data includes a secondary element. Moreover, the systems and methods may include creating the alternative delivery point code based upon the secondary element if the delivery data includes the secondary element. The secondary element may comprise a descriptor or a secondary number associated with the delivery point. If the delivery data does not include the secondary element, a normal delivery point code may be created.

36 Claims, 5 Drawing Sheets

METHODS AND SYSTEMS FOR PROVIDING AN ALTERNATIVE DELIVERY POINT CODE

RELATED APPLICATION

Under provisions of 35 U.S.C. §119(e), this Application claims the benefit of U.S. Provisional Application No. 60/462,555, filed Apr. 11, 2003, which is incorporated herein by reference.

BACKGROUND

I. Technical Field

The present invention generally relates to providing an alternative delivery point code. More particularly, the present invention relates to providing an alternative delivery point code based upon a secondary element if delivery data includes the secondary element.

II. Background Information

The United States Postal Service (USPS) is an independent government agency that provides mail delivery and other services to the public. The USPS is widely recognized as a safe and reliable means for sending and receiving mail and other items. With the advent and steady growth of electronic mail and electronic commerce, the physical mail stream will increasingly be utilized for sending and receiving packages and other items.

The USPS processes and delivers billions of items each year. The efficiency of the USPS, or other item delivery services, for example, may be impacted when items are not sorted for delivery according to each individual destination or delivery point. Sorting items according to each individual destination (for example, an apartment, a suite, or any other delivery point) may ensure a more expeditious delivery and decrease misdirected items.

Sequencing may be used to sort items for delivery. By proper sequencing, items may be sorted in the same order in which they are to be delivered. Consequently, as a delivery system operator traverses houses, apartments, businesses, and other destinations, sequenced items to be delivered by the delivery system operator have been pre-arranged (sequenced) in the same order that the delivery locations are visited. In order to properly sequence the items, it is important that each item's address correspond to a unique delivery point.

A delivery point's address may comprise, but is not limited to, a street record, a high rise record, a rural route, or a post office box, for example. A street record (or street number, for example) may identify a single delivery point such as a house or an office, for example. A problem may arise when there is more than one delivery point with the same address. Examples of multiple delivery points with the same address may include a house with an apartment built over a garage or a triplex with only one house number.

As illustrated in FIG. 1, the USPS, for example, currently uses the last two digits of the street address to identify the delivery point for sorting and sequencing purposes. For example, a house at 123 Main Street, Osage City, Kans. 66523-1439, may have a normal delivery point code comprising 66523-1439-23. However, if there were several apartments at the same address, the normal delivery point code may be the same for each apartment. For example, a first item 105 and a second item 110, while directed to two different apartments, may be given the same normal delivery point code of 23.

Great inefficiencies are created in the procedure described in FIG. 1 because, for example, two delivery points may have the same normal delivery point code. Accordingly, efficiently sorting, sequencing, and delivering items to two delivery points having the same normal delivery point code remains an elusive goal. Thus, there remains a need for efficiently providing improved delivery point codes that may be unique to each given delivery point. In addition, there remains a need for efficiently providing an improved delivery point code based upon a secondary element, if delivery data corresponding to the delivery point includes the secondary element.

SUMMARY

Consistent with embodiments of the present invention, systems and methods are disclosed for providing an alternative delivery point code.

In accordance with one embodiment, a method for providing an alternative delivery point code comprises receiving delivery data corresponding to a delivery point, determining if the delivery data includes a secondary element, and creating the alternative delivery point code based upon the secondary element if the delivery data includes the secondary element.

In accordance with another embodiment, a system for providing an alternative delivery point code comprises a memory storage for maintaining a database and a processing unit coupled to the memory storage, wherein the processing unit is operative to receive delivery data corresponding to a delivery point, determine if the delivery data includes a secondary element, and create the alternative delivery point code based upon the secondary element if the delivery data includes the secondary element.

In accordance with yet another embodiment, a computer-readable medium comprises a set of instructions which when executed perform a method providing an alternative delivery point code comprises receiving delivery data corresponding to a delivery point, determining if the delivery data includes a secondary element, and creating the alternative delivery point code based upon the secondary element if the delivery data includes the secondary element.

It is to be understood that both the foregoing general description and the following detailed description are exemplary and explanatory only, and should not be considered restrictive of the scope of the invention, as described and claimed. Further, features and/or variations may be provided in addition to those set forth herein. For example, embodiments of the invention may be directed to various combinations and sub-combinations of the features described in the detailed description.

BRIEF DESCRIPTION OF THE DRAWINGS

The accompanying drawings, which are incorporated in and constitute a part of this disclosure, illustrate various embodiments and aspects of the present invention. In the drawings.

DETAILED DESCRIPTION

Figure 1:
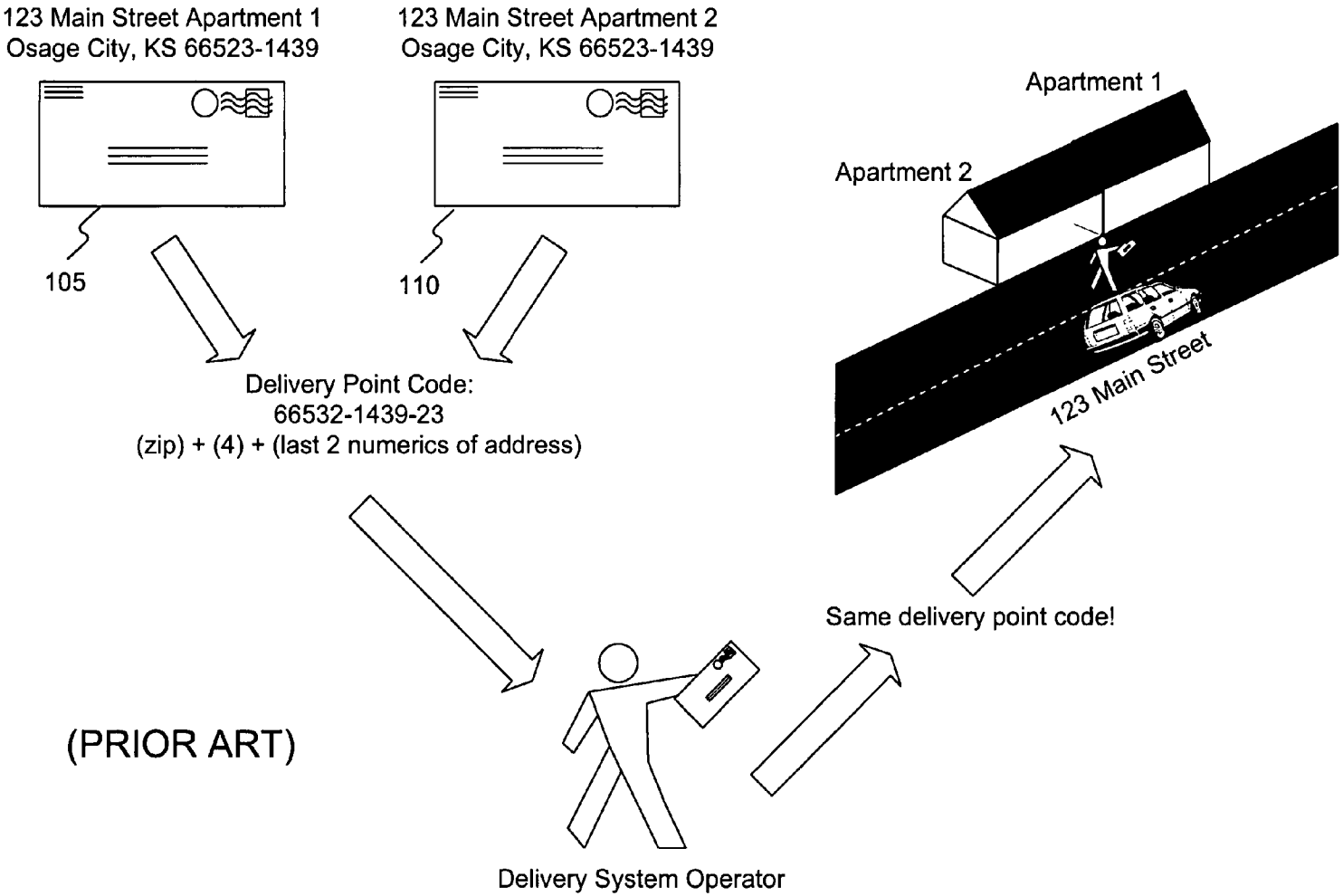
FIG. 1 illustrates a conventional delivery point coding procedure.

The following detailed description refers to the accompanying drawings. Wherever possible, the same reference numbers are used in the drawings and the following description to refer to the same or similar parts. While several exemplary embodiments and features of the invention are described herein, modifications, adaptations and other implementations are possible, without departing from the spirit and scope of the invention. For example, substitutions, additions or modifications may be made to the components illustrated in the drawings, and the exemplary methods described herein may be modified by substituting, reordering or adding steps to the disclosed methods. Accordingly, the following detailed description does not limit the invention. Instead, the proper scope of the invention is defined by the appended claims.

Systems and methods consistent with the invention may provide an alternative delivery point code. A delivery point may be a physical place to which a delivery service provider may deliver an item. A delivery point may be, for example, a street letterbox, a door slot, an apartment building box cluster, or a separate post office box. The aforementioned are exemplary, and delivery points may comprise any location where an item may be received. Furthermore, an item may comprise a mailpiece, a USPS Priority Mail package, a USPS Express Mail Package, or any other item to be delivered. The aforementioned are exemplary and the item may comprise any deliverable element.

Figure 2:
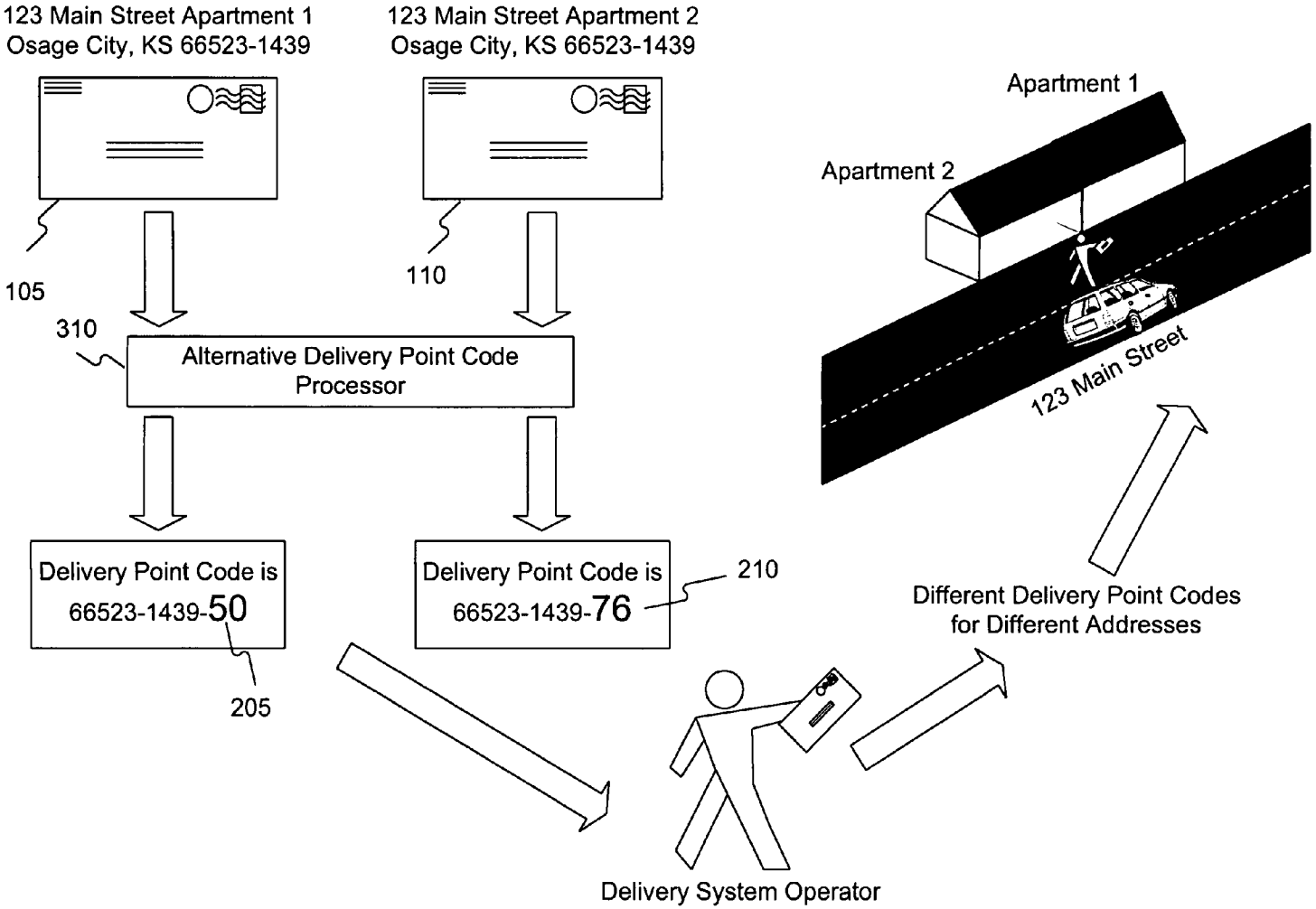
FIG. 2 illustrates an exemplary alternative delivery point coding procedure consistent with an embodiment of the present invention.

Systems and methods consistent with the invention may provide alternative delivery point codes unique to a given delivery point. As shown in FIG. 2, first item 105 may have the address 123 Main Street Apartment 1, Osage City, Kans. 66523-1439 and item 110 may have the address 123 Main Street Apartment 2, Osage City, Kans. 66523-1439. Consistent with an embodiment of the invention, an alternative delivery point code processor 310 may provide a first alternative delivery point code 205 of 50 for item 105. Similarly, alternative delivery point code processor 310 may provide a second alternative delivery point code 210 of 76 for item 110. Furthermore, first alternative delivery point code 205 may be a random or pseudo-random number based (or seeded) on the "1" from "Apartment 1" from the address of item 105. Likewise, second alternative delivery point code 210 may be a random or pseudo-random number based (or seeded) on the "2" from "Apartment 2" from the address of item 110. Alternative delivery point code processor 310 will be described in greater detail below with respect to FIG. 3.

An embodiment consistent with the invention may comprise a system for providing an alternative delivery point code. The system may comprise a memory storage for maintaining a database and a processing unit coupled to the memory storage. The processing unit may be operative to receive delivery data corresponding to a delivery point and to determine if the delivery data includes a secondary element. Furthermore, the processing unit may be operative to create the alternative delivery point code based upon the secondary element if the delivery data includes the secondary element.

Figure 3:
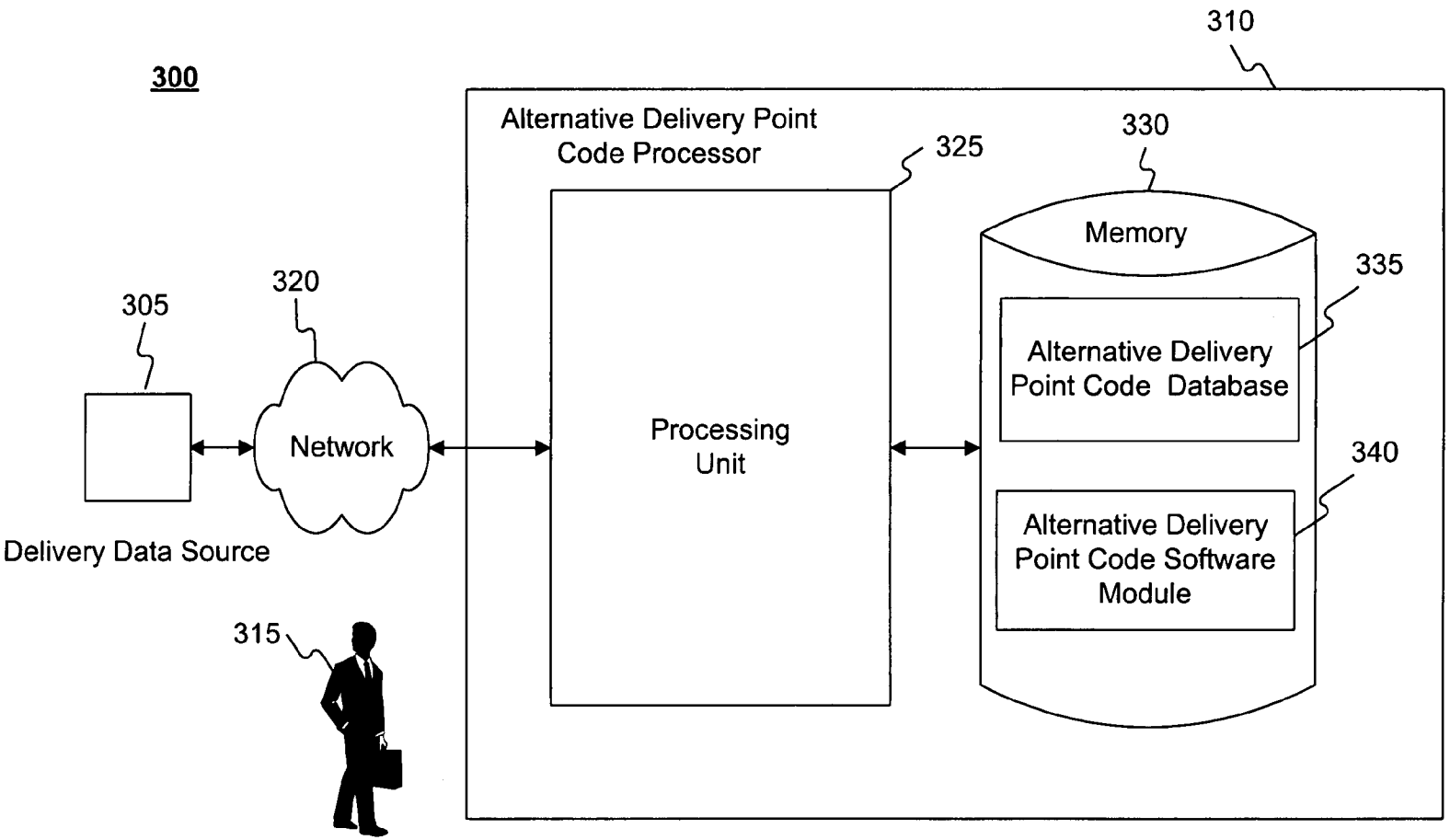
FIG. 3 is a block diagram of an exemplary alternative delivery point code system consistent with an embodiment of the present invention.

Consistent with an embodiment of the present invention, the aforementioned memory, processing unit, and other components may be implemented in an alternative delivery point code system, such as an exemplary alternative delivery point code system 300 of FIG. 3. Any suitable combination of hardware, software, and/or firmware may be used to implement the memory, processing unit, or other components. By way of example, the memory, processing unit, or other components may be implemented with alternative delivery point code processor 310 in combination with system 300. The aforementioned system and processor are exemplary and other systems and processors may comprise the aforementioned memory, processing unit, or other components, consistent with embodiments of the present invention.

By way of a non-limiting example, FIG. 3 illustrates system 300 in which the features and principles of the present invention may be implemented. As illustrated in the block diagram of FIG. 3, system 300 may include a delivery data source 305, alternative delivery point code processor 310, a user 315, and a network 320. User 315 may be an individual, for example, a delivery system operator, wishing to use processor 310 to create an alternative delivery point code. User 115 may also be an organization, enterprise, or any other entity having such desires. Delivery data source 305 may comprise equipment capable of reading or otherwise obtaining delivery data from an item. For example, the delivery data may comprise, but is not limited to, the address listed (coded or otherwise) on an item indicating where an item is to be delivered.

Processor 310 may include a processing unit 325 and a memory 330. Memory 330 may include an alternative delivery point code database 335 and an alternative delivery point code software module 340. Software module 340 may be executed on processing unit 325 and may access database 335. Software module 340 may include any program capable of at least implementing, for example, the exemplary methods described below with respect to FIG. 4 and FIG. 5.

Processor 310 ("the processor"), included in system 300, may be implemented using a personal computer, network computer, mainframe, or other similar microcomputer-based workstation. Processor 325 may also comprise any appropriate type of computer operating environment, such as handheld devices, multiprocessor systems, microprocessor-based or programmable sender electronic devices, minicomputers, mainframe computers, and the like. Processor 325 may also be practiced in distributed computing environments where tasks are performed by remote processing devices. Furthermore, processor 325 may comprise a mobile terminal, such as a smart phone, a cellular telephone, a cellular telephone utilizing wireless application protocol (WAP), personal digital assistant (PDA), intelligent pager, portable computer, a hand held computer, a conventional telephone, or a facsimile machine. The aforementioned systems and devices are exemplary and the processor may comprise other systems or devices.

Network 320 may comprise, for example, a local area network (LAN) or a wide area network (WAN). Such networking environments are commonplace in offices, enterprise-wide computer networks, intranets, and the Internet. When a LAN is used as network 320, a network interface located at the processor may be used to interconnect the processor with other systems. When network 320 is implemented in a WAN networking environment, such as the Internet, the processor may typically include an internal or external modem (not shown) or other means for establishing communications over the WAN. Further, in utilizing network 320, data sent over network 320 may be encrypted to insure data security by using known encryption/decryption techniques.

In addition to utilizing a wire line communications system as network 320, a wireless communications system, or a combination of wire line and wireless may be utilized as network 320 in order to, for example, exchange web pages via the Internet, exchange e-mails via the Internet, or for utilizing other communications channels. Wireless can be defined as radio transmission via the airwaves. However, it may be appreciated that various other communication techniques can be used to provide wireless transmission, including infrared line of sight, cellular, microwave, satellite, packet radio, and spread spectrum radio. The processor in the wireless environment can be any mobile terminal, such as the mobile terminals described above. Wireless data may include, but is not limited to, paging, text messaging, e-mail, Internet access and other specialized data applications specifically excluding or including voice transmission.

System 300 may also transmit data by methods and processes other than, or in combination with, network 320. These methods and processes may include, but are not limited to, transferring data via, diskette, CD ROM, facsimile, conventional mail, an interactive voice response system (IVR), or via voice over a publicly switched telephone network.

Figure 4:
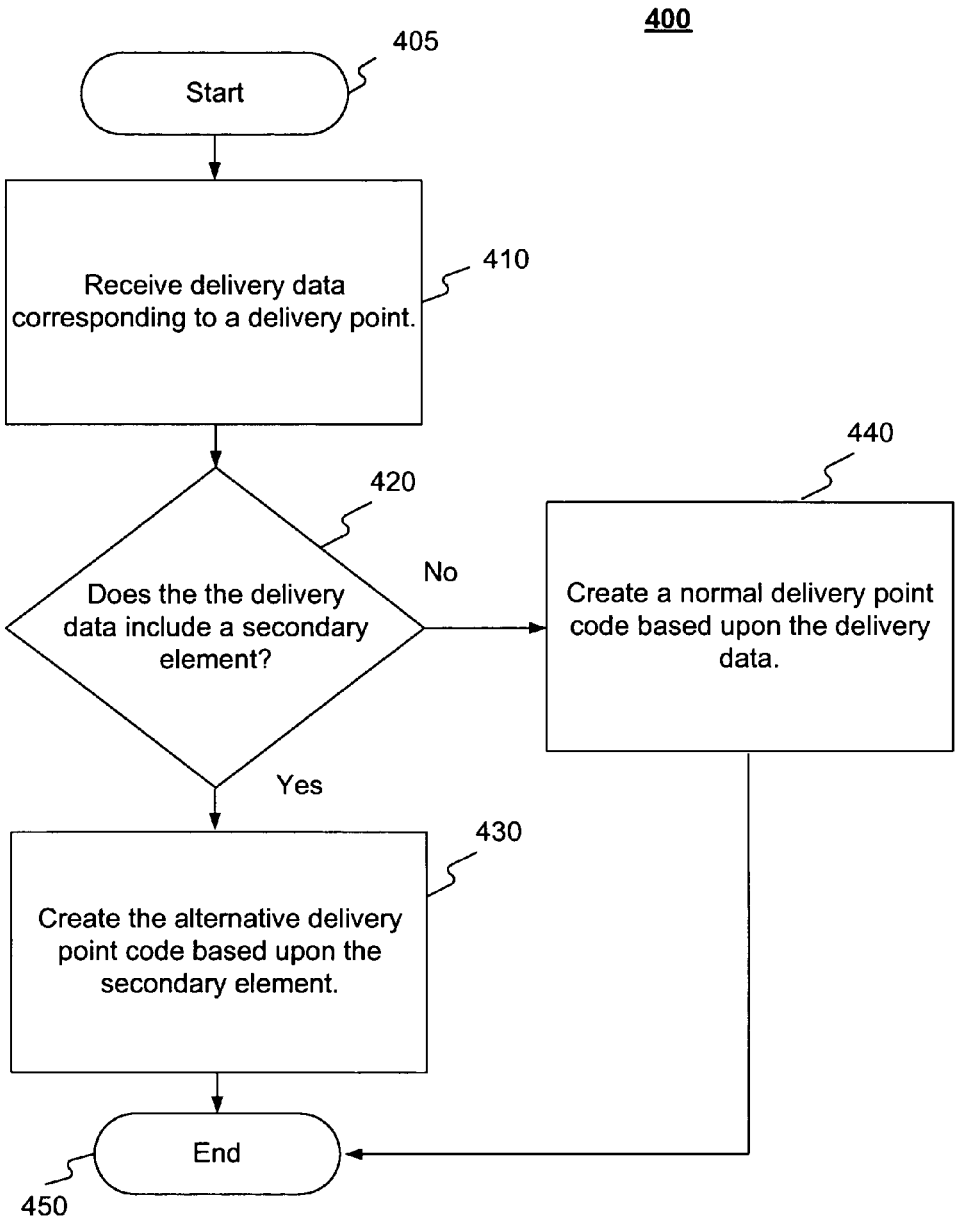
FIG. 4 is a flow chart of an exemplary method for providing an alternative delivery point code consistent with an embodiment of the present invention.

FIG. 4 is a flow chart setting forth the general stages involved in an exemplary method 400 for providing an alternative delivery point code. Exemplary ways to implement the stages of method 400 will be described in greater detail below. Exemplary method 400 may begin at starting block 405 and proceed to stage 410 where processor 310 may receive delivery data corresponding to a delivery point. For example, processor 310 may receive the delivery data from delivery data source 305 through network 320.

As stated previously, the delivery data may comprise, but is not limited to, the address listed (coded or otherwise) on an item indicating where the item is to be delivered. Based upon similarities between certain addresses, several conflicts may emerge. For example, each of the following addresses, under conventional delivery point schemes, may be sorted in the same way: i) 123 Main Street; ii) 123½ Main Street; iii) 123A Main Street; iv) 123B Main Street; v) 123 Main Street Front; vi) 123 Main Street Back; vii) 123 Main Street Apartment 1; and viii) 123 Main Street Apartment 2. In the aforementioned examples, the "½" in example ii) may be considered a "fractional number". The "A" and "B" in examples iii) and iv) may be considered "trailing alphas". Furthermore "front" and "back" in examples v) and vi) may be considered "descriptors". (Also UPPR or BSMT may be considered descriptors.) Moreover, the "1" and the "2" in "Apartment 1" and "Apartment 2" of examples vii) and viii), may be considered "secondary numbers". Consistent with embodiments of the invention "fractional numbers", "trailing alphas", "descriptors", and "secondary numbers" may be collectively referred to as secondary elements. The aforementioned secondary elements are exemplary, and other secondary elements maybe used.

After processor 310 receives the delivery data corresponding to the delivery point in stage 410, exemplary method 400 may continue to decision block 420 where processor 310 may determine if the delivery data includes a secondary element. For example, processor 310, executing software module 335, may parse the delivery data to determine if the delivery data includes a secondary element. For a specific example, processor 310, executing software module 335, may parse an exemplary delivery data including address "123 Main Street Apartment 1." Processor 310 may determine that this exemplary address has a secondary element comprising the secondary number "1". Moreover, processor 310 may determine that the address "123 Main Street Apartment 1" may include the following:

Normal Delivery Point Code: 23
Primary Address Number: 123
Trailing Alpha: None
Fractional Number: None
Secondary Number: 1
Descriptor: None.

From decision block 420, if processor 310 determines that the delivery data includes the secondary element, exemplary method 400 may proceed to exemplary subroutine 430 where processor 310 may create the alternative delivery point code based upon the secondary element. Exemplary ways to implement the stages of exemplary subroutine 430 will be described in greater detail below with respect to FIG. 5.

From decision block 420, if processor 310 determines, however, that the delivery data does not include the secondary element, exemplary method 400 may proceed to stage 440 where processor 310 may create a normal delivery point code based upon the delivery data. The normal delivery point code may comprise, but is not limited to, the two right-most digits in a primary address number of the delivery point. For example, processor 310, executing software module 335, may parse an exemplary delivery data including address "123 Main Street." Processor 310 may determine that this exemplary address does not have a secondary element and that the normal delivery point code is 23, for example.

Once processor 310 creates the alternative delivery point code based upon the secondary element in exemplary subroutine 430, or once processor 310 creates the normal delivery point code based upon the delivery data in stage 440, exemplary method 400 may end at stage 450.

Figure 5:
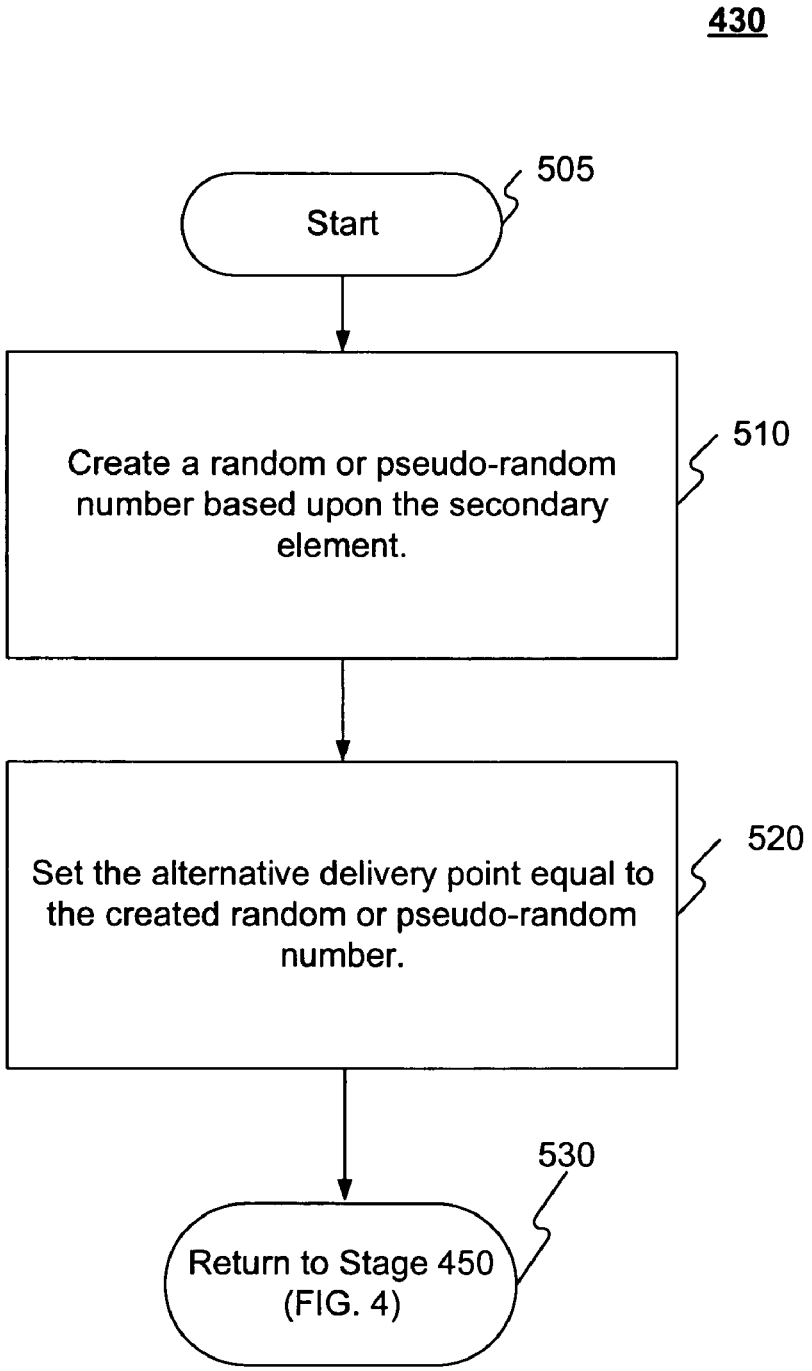
FIG. 5 is a flow chart of an exemplary subroutine used in the exemplary method of FIG. 4 for creating an alternative delivery point code consistent with an embodiment of the present invention.

FIG. 5 describes exemplary subroutine 430 from FIG. 4 for creating the alternative delivery point code based upon the secondary element if the delivery data includes the secondary element. Exemplary subroutine 430 may begin at starting block 505 and proceed to stage 510 where processor 310 may create a number, random, pseudo-random, or otherwise, based upon the secondary element. For example, processor 310, executing software module 340, may initialize a three element alphanumeric field with blanks and a three element numeric field with zeros. The three element alphanumeric field may comprise a first alphanumeric element, a second alphanumeric element, and a third alphanumeric element. And the three element numeric field may comprise a first numeric element, a second numeric element, and a third numeric element. Next, processor 310 may store data associated with the secondary element in either of the three element alphanumeric field or the three element numeric field. Then, processor 310 may convert the contents of the three element alphanumeric field to numeric data.

For example, processor 310 may store the secondary number or the descriptor into either a three-character alpha field filled initially with blanks or a three character numeric field initially filled with zeros. Processor 310 may fill the fields from right to left and store the results. If there is only one character in the secondary number field and it is numeric, processor 310 may convert it to an alpha character where 1=A, 2=B, 3=C, for example. For the exemplary address, "123 Main Street Apartment 1", the alpha field may comprise "blank, blank, A" and the numeric field may comprise "0, 0, 0".

After processor 310 initializes and fills the aforementioned data fields, processor 310 may calculate a value "S" characterizeable by the following equation:

$$S=((27^2)*(103)*(\text{the first alphanumeric element}))+((27^1)*(10^3)*(\text{the second alphanumeric element}))+((27^0)*(10^3)*(\text{the third alphanumeric element}))+((27^0)*(10^2)*(\text{the first numeric element}))+((27^0)*(10^1)*(\text{the second numeric element}))+((27^0)*(100)*(\text{the third numeric element})).$$

The above equation is exemplary, and others may be used to create a number, pseudo-random, random, or otherwise, based upon the secondary element, for example.

Next, processor 310 may determine a remainder corresponding to the value S divided by a random prime number. The random prime number may comprise, for example, 47. After processor 310 determines the remainder, processor 310 may then calculate a value R as the random number. The value R may be characterizeable by the following equation:

$$R=(\text{the remainder}*2)+(\text{a normal deliver point code associated with the delivery point})+1.$$

Again, the aforementioned equations are exemplary, and others may be used.

OPERATIONAL EXAMPLE

For the exemplary address "123 Main Street Apartment 1", the 1 in "Apartment 1" may be converted to "A". Accordingly, the alpha field may comprise "blank, blank, A" and the numeric field may comprise "zero, zero, zero". After converting the A to numeric (using alpha to numeric mapping), the following field may be created:

Alpha field 1=0
Alpha field 2=0
Alpha field 3=1
Numeric field 1=0
Numeric field 2=0
Numeric field 3=0

Placing the above fields in the aforementioned exemplary equation as follows, "S"=1,000:

$$\begin{aligned} S = {} & (27^2)*(10^3)*(0)+ \\ & (27^1)*(10^3)*(0)+ \\ & (27^0)*(10^3)*(1)+ \\ & (27^0)*(10^2)*(0)+ \\ & (27^0)*(10^1)*(0)+ \\ & (27^0)*(10^0)*(0) \\ = {} & 1000 \end{aligned}$$

Dividing 1000 by 47 leaves a remainder of 13. Because 23 is the normal delivery point code for this example, from the aforementioned exemplary equation, "R"=(2*13)+23+1=50. Accordingly, an alternate delivery point code for the above address is 50 in this example.

In those instances where the secondary element is a fraction, such as ½, embodiments of the invention may convert this fraction to a numeric value. For the fractional value 12, for example, the assigned numeric value may be 99. Other fractional values may also receive different numeric values.

From stage 510 where processor 310 creates the random or pseudo-random number based upon the secondary element, exemplary subroutine 430 continues to stage 520 where processor 310 may set the alternative delivery point code equal to the created random or pseudo-random number. For example, processor 310 may, consistent with the aforementioned example, set the alternative delivery point code to 50. Once processor 310 sets the alternative delivery point equal to the created random or pseudo-random number in stage 520, exemplary subroutine 430, may continue to stage 530 and returns to stage 450 of FIG. 4.

Consistent was an embodiment of the invention, a two-digit alternate delivery point code, for example, may be used in conjunction with conventional delivery system equipment. For example, with respect to the USPS, a two-digit alternate delivery point code may not require a complete re-recording of every address, a change in current bar code readers, or a change in the mail operations equipment that reads, evaluates, and prints the current 11 digit delivery point bar code on mailpieces.

A conventional two-digit normal delivery point code may be calculated through the use of a reference database product that assigns, for example, a correct ZIP+4 code to a physical address and standardizes the address. This reference product is commonly referred to as a ZIP+4 engine. Consistent with an embodiment of the invention, software module 340, for example, may be incorporated into a ZIP+4 engine as a vehicle to correctly sequence deliveries. A ZIP+4 engine may have the functionality to evaluate an address and separate it into its components, delivery address line, and the last line (City, State, ZIP+4).

While certain features and embodiments of the invention have been described, other embodiments of the invention will be apparent to those skilled in the art from consideration of the specification and practice of the embodiments of the invention disclosed herein. Furthermore, although embodiments of the present invention have been described as being associated with data stored in memory and other storage mediums, one skilled in the art will appreciate that these aspects can also be stored on or read from other types of computer-readable media, such as secondary storage devices, like hard disks, floppy disks, or a CD-ROM, a carrier wave from the Internet, or other forms of RAM or ROM. Further, the steps of the disclosed methods may be modified in any manner, including by reordering steps and/or inserting or deleting steps, without departing from the principles of the invention.

It is intended, therefore, that the specification and examples be considered as exemplary only, with a true scope and spirit of the invention being indicated by the following claims and their full scope of equivalents.

What is claimed is:

1. A computer-implemented method for providing an alternative delivery point code, the method comprising:

receiving delivery data corresponding to a delivery point;

determining, via a processor, whether to create a normal delivery code or the alternative delivery point code based on whether a plurality of possible delivery locations exist at the delivery point, wherein a plurality of possible delivery locations are shown to exist at the delivery point when the delivery data includes a secondary element that specifies a particular location at the delivery point;

creating, via the processor, the normal delivery point code when the delivery data does not include the secondary element, wherein the normal delivery point code is used to sequence delivery to a location among different delivery locations;

creating, via the processor, the alternative delivery point code when the delivery data includes the secondary element, wherein the alternate delivery point code contains the same number of digits as the normal delivery point code, wherein the alternate delivery code distinguishes the particular location at the delivery point from the plurality of possible delivery locations at the delivery point, wherein the alternate delivery point code is used to sequence delivery to the particular location at the delivery point from among the plurality of possible delivery locations at the delivery point, and wherein the creating comprises:

calculating, based on the secondary element, one of a random number or a pseudo-random number and setting at least one digit of the alternative delivery point code to the calculated number, wherein creating the random number comprises calculating a value S and determining a remainder corresponding to the value S divided by a random prime number; and when the secondary element contains alphanumeric data, converting the alphanumeric data to numeric data; and affixing the alternate delivery point code onto a mail item for use in sequencing delivery of the mail item, including sequencing between the plurality of possible delivery locations at the delivery point.

2. The method of claim 1, wherein the secondary element comprises at least one of a fractional number, a trailing alpha, a descriptor, and a secondary number.

3. The method of claim 1, further comprising creating a normal delivery point code based upon the delivery data if the delivery data does not include the secondary element.

4. The method of claim 3, wherein the normal delivery point code comprises the two right-most digits in a primary address number of the delivery point.

5. The method of claim 1, wherein creating the random number further comprises initializing an alphanumeric field with blanks and a numeric field with zeros, the three element alphanumeric field comprising a first alphanumeric element, a second alphanumeric element, and a third alphanumeric element, and the three element numeric field comprising a first numeric element, a second numeric element, and a third numeric element.

6. The method of claim 5, wherein creating the random number further comprises storing data associated with the secondary element in one of the three element alphanumeric field and the three element numeric field.

7. The method of claim 6, wherein a the value S is calculated able by the following equation:

$$S=((27^2)*(10^3)*(\text{the first alphanumeric element}))+((27^1)*(10^3)*(\text{the second alphanumeric element}))+((27^{\circ}*(10^3)*(\text{the third alphanumeric element}))+((27^{\circ}*(10^2)*(\text{the first numeric element}))+((27^{\circ}*(10^1)*(\text{the second numeric element}))+((27^{\circ}*)(10^{\circ}*(\text{the third numeric element})).$$

8. The method of claim 7, wherein creating the random number further comprises calculating a value R as the random number, the value R characterizeable by the following equation:

$$R=(\text{the remainder}*2)+(\text{a normal deliver point code associated with the delivery point})+1.$$

9. The method of claim 7, wherein the random prime number is 47.

10. The method of claim 5, wherein the normal delivery point code associated with the delivery point comprises the two right-most digits in a primary address number of the delivery point.

11. The method of claim 1, wherein the alternative delivery point code is numeric.

12. The method of claim 1, wherein the alternative delivery point code comprises one of two digits and two alphanumeric characters.

13. A system for providing an alternative delivery point code, the system comprising:

a memory storage for maintaining a database; and a processing unit coupled to the memory storage, wherein the processing unit is operative to:

receive delivery data corresponding to a delivery point;

determine whether to create a normal delivery code or the alternative delivery point code based on whether a plurality of possible delivery locations exist at the delivery point, wherein a plurality of possible delivery locations are shown to exist at the delivery point when the delivery data includes a secondary element that specifies a particular location at the delivery point;

create the normal delivery point if the delivery data does not include the secondary element, wherein the normal delivery point code is used to sequence delivery to a location among a plurality of locations; and create the alternative delivery point code if the delivery data includes the secondary element, wherein the alternate delivery point code contains the same number of digits as the normal delivery point code, wherein the alternate delivery code distinguishes the particular location from the plurality of possible delivery locations at the delivery point, wherein the alternate delivery point code is used to sequence delivery to the particular location at the delivery point from among the plurality of possible delivery locations at the delivery point, and wherein the creating comprises calculating, based upon the secondary element, one of a random number or a pseudo-random number and setting at least one digit of the alternative delivery point code to the calculated number, wherein the calculating further includes converting first numeric data in the secondary element to different numeric data, wherein creating the random number comprises calculating a value S and determining a remainder corresponding to the value S divided by a random prime number; and a machine that affixes the alternate delivery point code onto a mail item for use in a sequenced delivery, including sequencing between the plurality of possible delivery locations at the delivery point.

14. The system of claim 13, wherein the secondary element comprises at least one of a fractional number, a trailing alpha, a descriptor, and a secondary number.

15. The system of claim 13, wherein the processing unit is further configured to create a normal delivery point code based upon the delivery data if the delivery data does not include the secondary element.

16. The system of claim 15, wherein the normal delivery point code comprises the two right-most digits in a primary address number of the delivery point.

17. The system of claim 13, wherein the processing unit being configured to create the random number further comprises the processing unit being configured to initialize a three element alphanumeric field with blanks and a three element numeric field with zeros, the three element alphanumeric field comprising a first alphanumeric element, a second alphanumeric element, and a third alphanumeric element, and the three element numeric field comprising a first numeric element, a second numeric element, and a third numeric element.

18. The system of claim 17, wherein the processing unit being configured to create the random number further stores data associated with the secondary element in one of the three element alphanumeric field and the three element numeric field.

19. The system of claim 18, wherein the value S is characterizeable by the following equation:

$S=((27^2)*(10^3)*(\text{the first alphanumeric element}))+((27^1)*(10^3)*(\text{the second alphanumeric element}))+((27^{\circ}*(10^3)*(\text{the third alphanumeric element}))+((27^{\circ}*(10^2)*(\text{the first numeric element}))+((27^{\circ}*(10^1)*(\text{the second numeric element}))+((27^{\circ}*)(10^{\circ}*(\text{the third numeric element}))$.

20. The system of claim 19, wherein the processing unit being configured to create the random number further calculates a value R as the random number, the value R characterizeable by the following equation:

$R=(\text{the remainder}*2)+(\text{a normal deliver point code associated with the delivery point})+1$.

21. The system of claim 19, wherein the random prime number is 47.

22. The system of claim 5, wherein the normal delivery point code associated with the delivery point comprises the two right-most digits in a primary address number of the delivery point.

23. The system of claim 13, wherein the alternative delivery point code is numeric.

24. The system of claim 13, wherein the alternative delivery point code comprises one of two digits and two alphanumeric characters.

25. A non-transitory computer-readable medium comprising a set of instructions which when executed perform a method providing an alternative delivery point code, the method comprising:

receiving delivery data corresponding to a delivery point;

determining whether to create a normal delivery code or the alternative delivery point code based on whether a plurality of possible delivery locations exist at the delivery point, wherein a plurality of possible delivery locations are shown to exist at the delivery point when the delivery data includes a secondary element that specifies a particular location at the delivery point;

creating the normal delivery point code when the delivery data does not include the secondary element, wherein the normal delivery point code is used to sequence delivery to a location among a plurality of locations; and creating the alternative delivery point code if the delivery data includes the secondary element, wherein the alternate delivery point code contains the same number of digits as the normal delivery point code, wherein the alternate delivery code distinguishes the particular location at the delivery point from the plurality of possible delivery locations at the delivery point, wherein the alternate delivery point code is affixed onto a mail item and used to sequence delivery to the particular location at the delivery point from among the plurality of possible delivery locations at the delivery point, and wherein the creating comprises calculating, based upon the secondary element, one of a random number or a pseudo-random number and setting at least one digit of the alternative delivery point code to the calculated number, wherein the calculating further includes converting first numeric data in the secondary element into different numeric data wherein creating the random number comprises calculating a value S and determining a remainder corresponding to the value S divided by a random prime number.

26. The computer-readable medium of claim 25, wherein the secondary element comprises at least one of a fractional number, a trailing alpha, a descriptors, and a secondary number.

27. The computer-readable medium of claim 25, further comprising creating a normal delivery point code based upon the delivery data if the delivery data does not include the secondary element.

28. The computer-readable medium of claim 27, wherein the normal delivery point code comprises the two right-most digits in a primary address number of the delivery point.

29. The computer-readable medium of claim 25, wherein creating the random number further comprises initializing a three element alphanumeric field with blanks and a three element numeric field with zeros, the three element alphanumeric field comprising a first alphanumeric element, a second alphanumeric element, and a third alphanumeric element, and the three element numeric field comprising a first numeric element, a second numeric element, and a third numeric element.

30. The computer-readable medium of claim 29, wherein creating the random number further comprises storing data associated with the secondary element in one of the three element alphanumeric field and the three element numeric field.

31. The computer-readable medium of claim 30, wherein the value S is characterizeable by the following equation:

$S=((27^2)*(10^3)*(\text{the first alphanumeric element}))+((27^1)*(10^3)*(\text{the second alphanumeric element}))+((27^{\circ}*(10^3)*(\text{the third alphanumeric element}))+((27^{\circ}*(10^2)*(\text{the first numeric element}))+((27^{\circ}*(10^1)*(\text{the second numeric element}))+((27^{\circ}*)(10^{\circ}*(\text{the third numeric element}))$.

32. The computer-readable medium of claim 31, wherein creating the random number further comprises calculating a value R as the random number, the value R characterizeable by the following equation:

$R=(\text{the remainder}*2)+(\text{a normal deliver point code associated with the delivery point})+1$.

33. The computer-readable medium of claim 31, wherein the random prime number is 47.

34. The computer-readable medium of claim 29, wherein the normal delivery point code associated with the delivery point comprises the two right-most digits in a primary address number of the delivery point.

35. The computer-readable medium of claim 25, wherein the alternative delivery point code is numeric.

36. The computer-readable medium of claim 25, wherein the alternative delivery point code comprises one of two digits and two alphanumeric characters.

* * * * *